United States Patent [19]

Manke

[11] Patent Number: 4,664,196

[45] Date of Patent: May 12, 1987

[54] DOWNHOLE TOOL WITH COMPRESSIBLE LIQUID SPRING CHAMBER

[75] Inventor: Kevin R. Manke, Marlow, Okla.

[73] Assignee: Halliburton Company, Duncan, Okla.

[21] Appl. No.: 792,410

[22] Filed: Oct. 28, 1985

[51] Int. Cl.[4] ..... F21B 34/10

[52] U.S. Cl. ..... 166/378; 166/102; 166/321

[58] Field of Search ..... 166/264, 321, 324, 323, 166/374, 102, 378

[56] References Cited

U.S. PATENT DOCUMENTS

| | | | |
|---|---|---|---|
| 3,856,085 | 12/1974 | Holden et al. | 166/264 |
| 4,083,409 | 4/1978 | Barrington | 166/320 |
| 4,109,724 | 8/1978 | Barrington | 166/321 X |
| 4,109,725 | 8/1978 | Williamson et al. | 166/321 X |
| 4,341,266 | 7/1982 | Craig | 166/317 |
| 4,346,770 | 8/1982 | Beck | 175/297 |
| 4,422,506 | 12/1983 | Beck | 166/324 |
| 4,429,748 | 2/1984 | Beck | 166/324 |
| 4,444,268 | 4/1984 | Barrington | 166/373 |
| 4,448,254 | 5/1984 | Barrington | 166/373 |
| 4,489,786 | 12/1984 | Beck | 166/374 |
| 4,515,219 | 5/1985 | Beck | 166/374 |
| 4,573,535 | 3/1986 | Manke | 166/321 |

OTHER PUBLICATIONS

Exhibit A—A drawing entitled "APR-N Tester Valve with Double-Volume Chamber".

*Primary Examiner*—Stephen J. Novosad
*Assistant Examiner*—David J. Bagnell
*Attorney, Agent, or Firm*—Joseph A. Walkowski

[57] ABSTRACT

A downhole tool such as a tester valve originally constructed to operate with a compressible gas spring may be modified to operate with a compressible liquid spring. The volume of a spring chamber is increased. A differential area of a power piston is decreased. A flow restriction in a metering cartridge associated with the spring chamber is increased. Also, a relief valve is provided to allow fluid to be relieved from the tool into the well annulus upon expansion of the compressible liquid due to heating as the tool is lowered into a well if the expansion of liquid exceeds the available volume in the tool.

15 Claims, 8 Drawing Figures

DOWNHOLE TOOL WITH COMPRESSIBLE LIQUID SPRING CHAMBER

BACKGROUND OF THE INVENTION

1. Field of the Invention

The present invention relates generally to annulus pressure responsive downhole tools utilizing a compressible liquid spring.

2. Description of the Prior Art

The prior art includes a number of downhole tools, such as flow tester valves and circulating valves, which are designed to operate in response to changes in pressure in a well annulus between a tool string and a well casing. Typically, these tools include a differential area piston, which may generally be referred to as a power piston, having one side communicated with well annulus pressure and having another side communicated with a compressible fluid spring chamber.

The compressible fluid spring chamber typically has been filled either with a compressible gas such as nitrogen or a compressible liquid such as silicone oil.

When well annulus pressure is increased to move the power piston of the tool, the fluid in the spring chamber is compressed. Upon decreasing the well annulus pressure, the compressed fluid in the spring chamber expands to aid in returning the power piston to its original position.

Typical examples of prior art tools utilizing compressible nitrogen spring chambers are seen in U.S. Pat. Nos. 4,422,506; 4,429,748; 4,489,786; and 4,515,219, all to Beck and all assigned to the assignee of the present invention.

Two prior art circulating valves utilizing compressible silicone oil spring chambers are shown in U.S. Pat. Nos. 4,109,724 to Barrington and 4,109,725 to Williamson et al., both assigned to the assignee of the present invention.

Two prior art tester valves utilizing silicone spring chambers are shown in U.S. Pat. Nos. 4,444,268 and 4,448,254, both to Barrington and both assigned to the assignee of the present invention.

The present invention relates to a particular design for a downhole tool using a compressible liquid spring chamber, preferably using silicone oil, which may be utilized to convert a typical prior art tool originally designed for use with a compressible nitrogen spring chamber to a compressible liquid spring chamber design.

Also provided are improvements generally applicable to compressible liquid spring chamber tools with regard to the use of a relief valve to allow for expansion of the compressible liquid upon heating as the tool is lowered into a well.

Numerous objects, features and advantages of the present invention will be readily apparent to those skilled in the art upon a reading of the following disclosure when taken in conjunction with the accompanying drawings.

DETAILED DESCRIPTION OF THE PREFERRED EMBODIMENTS

Figure 1A:
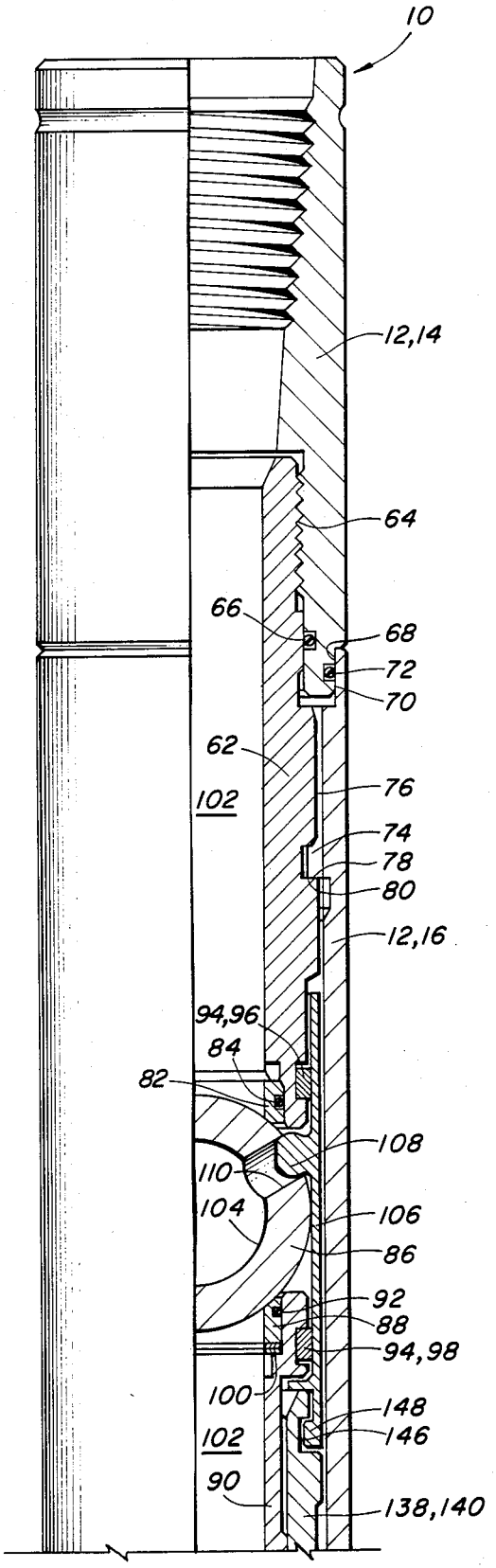
FIGS. 1A–1H comprise an elevation view of a downhole tool embodying the present invention, with the right side of the tool shown in section.

During the course of drilling an oil well, the borehole is filled with a fluid known as drilling fluid or drilling mud. One of the purposes of this drilling fluid is to contain in intersected formations any formation fluid which may be found therein. To contain these formation fluids, the drilling mud is weighted with various additives so that the hydrostatic pressure of the mud at the formation depth is sufficient to maintain the formation fluid within the formation without allowing it to escape into the borehole.

When it is desired to test the production capabilities of the formation, a testing string is lowered into the borehole to the formation depth and the formation fluid is allowed to flow into the string in a controlled testing program. Lower pressure is maintained in the interior of the testing string as it is lowered into the borehole. This is usually done by keeping a valve in the closed position near the lower end of the testing string. When the testing depth is reached, a packer is set to seal the borehole thus closing in the formation from the hydrostatic pressure of the drilling fluid in the well annulus.

The valve at the lower end of the testing string, which is generally referred to as a tester valve, is then opened and the formation fluid, free from the restraining pressure of the drilling fluid, can flow into the interior of the testing string.

The testing string will include a number of tools, many of which may be constructed to be operated in response to changes in pressure within the well annulus.

Two tools which are typically present in a testing string, and which are often constructed to be operated in response to changes in well annulus pressure are those tools commonly referred to as tester valves, and those tools which are commonly referred to as circulating valves.

A detailed description of the general makeup of such a testing string as utilized in an offshore environment, and indicating the location of tester valves and circulating valves in such a string, is shown, for example, in U.S. Pat. No. 4,444,254 to Barrington, with regard to FIG. 1 thereof, the details of which are incorporated herein by reference.

FIGS. 1A–1H of the present application comprise an elevation, right-side sectioned view, of a flow tester valve apparatus 10 of the type which may be used in such a testing string as that just described.

The valve apparatus 10 includes an outer housing 12. The outer housing 12 itself includes an upper housing adapter 14, a valve housing section 16, a shear nipple 18, a power housing section 20, a spring chamber connector nipple 22, an upper spring chamber housing section 24 including concentric inner and outer tubular members 26 and 28, an upper filler nipple 30, a lower spring chamber housing section 32 including concentric inner and outer tubular member assemblies 34 and 36, a spring chamber to equalizing chamber connector nipple 38, an equalizing chamber housing section 40 including concentric inner and outer members 42 and 44, and a lower housing adapter 46.

The inner and outer concentric tubular assemblies 34 and 36, respectively, of lower spring chamber housing section 32 are each made up of a plurality of interconnected elements.

Inner tubular assembly 34 includes first, second, third and fourth interconnected portions 48, 50, 52 and 54, respectively.

Outer tubular assembly 36 includes a first housing section 56, a lower filler nipple 58 and a second housing section 60.

Referring to FIG. 1A, a holder mandrel 62 has its upper end threadedly connected to upper adapter 14 at threaded connection 64 with a seal being provided therebetween by O-ring 66.

The valve housing section 16 has an upper inner cylindrical surface 68 in which is closely received a lower outer cylindrical surface 70 of upper adapter 14 with a seal being provided therebetween by O-ring 72.

The valve housing section 16 includes a plurality of radially inward extending splines 74 which are meshed with a plurality of radially outward extending splines 76 of holder mandrel 62 to prevent relative rotation therebetween.

Holder mandrel 62 includes a radially outwardly extending upward facing ledge 78 which is located below and engages lower ends 80 of the radially inward extending splines 74 so that the valve housing section 16 is held longitudinally fixed relative to the upper housing adapter 14 by means of holder mandrel 62.

An upper annular valve seat 82 is received in a lower inner bore of holder mandrel 62 with a seal being provided therebetween by O-ring 84.

A spherical ball valve member 86 sealingly engages upper seat 82, and also sealingly engages a lower annular seat 88.

Lower seat 88 is received within an upper inner bore of a lower seat holder mandrel 90 with a seal being provided therebetween by O-ring 92.

The lower seat holder mandrel 90 is held in place relative to upper holder mandrel 62 by a C-clamp 94 which has upper and lower ends 96 and 98 which are visible in FIG. 1A.

A pair of Belleville springs 100 bias the lower annular seat 88 against the spherical ball valve member 86.

The tester valve 10 has a longitudinal flow passage 102 disposed therethrough. The ball valve member 86 is shown in FIG. 1A in a closed position closing the flow passage 102.

Ball valve member 86 has a cylindrical ball valve bore 104 disposed therethrough which can be aligned with the flow passage 102 to place the tester valve 10 in an open position.

An actuating arm 106 having an actuating lug 108 disposed thereon engages an eccentric bore 110 disposed through the side of ball valve member 86 so that the ball valve member 86 may be rotated to an open position upon downward movement of actuating arm 106 relative to the housing 12.

Actually, there are two such actuating arms 106 with lugs 108 engaging two eccentric bores 110 in a manner such as that illustrated and described in detail in U.S. Pat. No. 3,856,085 to Holden et al., and assigned to the assignee of the present invention.

A power mandrel means 112 includes a top power mandrel section 114 and a bottom power mandrel section 116 which are threadedly connected together at 118, with a seal 119 being provided therebetween. Formed on the bottom power mandrel section 116 is a power piston 120 which is received within a cylindrical inner bore 122 of power housing section 20. A sliding seal means 124 seals between power piston 120 and bore 122.

Top power mandrel section 114 includes radially outward extending splines 126 which mesh with a plurality of radially inward extending splines 128 of shear nipple 18 to prevent relative rotation therebetween.

An intermediate portion of top power mandrel section 114 is closely received within a bore 130 of shear nipple 18 and a seal is provided therebetween by seals 132.

A power mandrel cap 134 is threadedly attached at 136 to the upper end of top power mandrel section 114.

A connector assembly 138 includes an upper connector piece 140 and a lower connector piece 142 threadedly connected together at 144.

The upper connector piece 140 includes a groove 146 within which is received a lip 148 of actuating arm 106 so that actuating arm 106 and upper connector piece 140 move together longitudinally within the housing 12.

The power mandrel cap 134 is held between upward and downward facing surfaces 150 and 152 of connector assembly 138 so that upon longitudinal movement of power mandrel means 112, the connector assembly 138 moves longitudinally therewith which also moves the actuating arms 106 longitudinally therewith so as to operate the ball valve 86.

The lower seat holder mandrel 90 has a cylindrical outer surface 154 which is closely received within a bore 156 of upper connector assembly piece 140 with a seal being provided therebetween by O-ring 158.

Lower connector assembly piece 142 has an outer cylindrical surface 160 of top power mandrel section 114 closely received within a bore 162 thereof with a seal being provided therebetween by O-ring 164.

An outer surface 166 of lower connector assembly piece 142 is closely and slidably received within a bore 168 of valve housing section 16 with a sliding seal being provided therebetween by O-ring 170.

A plurality of radially extending ports 172 are disposed through top power mandrel section 114 to prevent hydraulic lockup when the power mandrel means 112 moves the connector assembly 138.

The valve housing section 16 is threadedly connected to shear nipple 18 at 174 with a seal being provided therebetween by O-ring 176.

Disposed in upper shear nipple 18 are one or more shear pins 178 held in place by shear pin holders 180 which are threaded into the upper shear nipple 18.

Each of the shear pins 178 are initially partly received within an outer annular groove 182 of top power mandrel section 114 so as to initially pin the power mandrel means 112 in the position illustrated in the figures thus holding the ball valve 86 in a closed position. As is further explained below, upon applying an appropriate differential pressure across the power piston 120, the shear pins 178 will shear thus releasing the power mandrel means 112 and allowing it to move the ball valve 86 to an open position with its bore 104 aligned with the flow passage 102 of the tool 10.

Upper shear nipple 18 is threadedly connected to power housing section 20 at 184 with a seal being provided therebetween by O-ring 186.

Disposed through the wall of power housing section 20 above the seals 124 of power piston 120 are one or more power ports 188 for communicating an upper side 190 of power piston 120 with the well annulus exterior of the housing 12.

As will be understood by those skilled in the art, the power piston 120 is actually defined as the annular area between an outside diameter defined by seal 124 engaging the bore 122 and an inside diameter defined by seal 206 engaging an outer surface 202 of bottom power mandrel section 116.

A lower side 192 of power piston 122 is communicated with a spring chamber 194 defined within the housing 12.

The spring chamber 194 includes a first chamber portion 196 located between power piston 120 and first spring chamber connector nipple 22, a second spring chamber portion 198 defined between spring chamber connector nipple 22 and upper filler nipple 30, and a third spring chamber portion 200 longitudinally defined between the upper filler nipple 30 and the spring chamber to equalizing chamber connector nipple 38.

First spring chamber portion 196 is radially defined between the bottom power mandrel section 116 and the power housing section 20.

An outer surface 202 of the lower portion of bottom power mandrel section 116 is closely and slidably received within a bore 204 of spring chamber connector nipple 22 with two longitudinally spaced seals 206 and 208 being provided therebetween.

Power housing section 20 is threadedly connected to spring chamber connector nipple 22 at 210 with a seal being provided therebetween by seal 212.

One or more relief holes 214 communicate the well annulus with an inner annular groove 216 of spring chamber connector nipple 22 between the seals 206 and 208 to prevent hydraulic lockup of the power mandrel means 112 as it moves within the spring chamber connector nipple 22.

The lower end of spring chamber connector nipple 22 is threadedly connected to inner member 26 of upper spring chamber housing section 24 at threaded connection 218 with a seal being provided therebetween at 220.

Outer concentric member 28 of upper spring chamber housing section 24 is threadedly connected at 222 to the lower end of spring chamber connector nipple 22 with a seal being provided therebetween by seal means 224.

A plurality of longitudinally extending ports 226 are disposed through first spring chamber connector nipple 22 to communicate the first spring chamber portion 196 and the second spring chamber portion 198.

The second spring chamber portion 198 is radially defined between the inner and outer concentric members 26 and 28 of upper spring chamber housing section 24.

An outer cylindrical surface 228 of inner concentric member 26 is closely received within a bore 230 of upper filler nipple 30 with a pair of seals being provided therebetween by seals 232 and 234. Upper filler nipple 30 possesses a fluid fill port and plug therein, not shown, such as are well known in the art.

A plurality of relief holes 236 communicate an inner annular groove 238 of second spring chamber connector nipple 30 with the well annulus.

The outer concentric member 28 of upper spring chamber housing section 24 is threadedly connected to upper filler nipple 30 at 240 with a seal being provided therebetween by seals 242.

A plurality of longitudinally extending ports 244 are disposed through upper filler nipple 30 to communicate second spring chamber portion 198 with third spring chamber portion 200.

The third spring chamber portion 200 is radially defined between the inner tubular assembly 34 and the outer tubular assembly 36 of the lower spring chamber housing section 32. As previously described, the inner and outer assemblies 34 and 36 of lower spring chamber housing section 32 are each constructed from a plurality of interconnected members.

The first portion 48 of inner assembly 32 is threadedly connected at 246 to upper filler nipple 30 with a seal being provided therebetween at 248.

First and second portions 48 and 50 of inner assembly 34 are threadedly connected together at 250 with a seal being provided therebetween at 252.

An outer cylindrical surface 254 of a lower end of second portion 50 is closely received within a bore 256 of third portion 52 with a seal being provided therebetween at 258.

Third and fourth portions 52 and 54 of inner assembly 34 are threadedly connected together at 260 with a seal being provided therebetween at 262.

An outer cylindrical surface 264 of fourth portion 54 of inner assembly 34 is closely received within a bore 266 of spring chamber to equalizing chamber connector nipple 38 with a seal being provided therebetween at 268.

With regard to the outer assembly 36 of lower spring chamber housing section 32, the first housing section 56 thereof is threadedly connected at 270 to second spring chamber connector nipple 230 with a seal being provided therebetween at 272.

First housing section 56 is threadedly connected to lower filler nipple 58 at threaded connection 274 with a seal being provided therebetween at 276.

Lower filler nipple 58 is threadedly connected to second housing section 60 of the outer assembly 36 at threaded connection 278 with a seal being provided therebetween at 280.

Second housing section 60 is threadedly connected to spring chamber to equalizing chamber connector nipple 38 at threaded connection 282 with a seal being provided therebetween at 284.

Lower filler nipple 58 has a fill port 286 disposed therethrough which is closed by a plug 288.

Defined longitudinally between spring chamber to equalizing chamber connector nipple 38 and lower adapter 46 is an equalizing chamber 290. The equalizing chamber 290 is radially defined as the annular space between inner and outer members 42 and 44 of equalizing chamber housing section 40.

The inner member 42 is threadedly connected to spring chamber to equalizing chamber connector nipple 38 at threaded connection 292 with a seal being provided therebetween at 294.

Outer tubular member 44 is threadedly connected to spring chamber to equalizing chamber connector nipple 38 at threaded connection 296 with a seal being provided therebetween at 298.

An outer cylindrical surface 300 of inner tubular member 42 is closely received within a bore 302 of lower housing adapter 46 with a seal being provided therebetween at 304.

Outer tubular member 44 is threadedly connected to lower housing adapter 46 at threaded connection 305.

An equalizing port 306 is disposed through outer tubular member 44 of equalizing chamber housing section 40 to communicate the equalizing chamber 290 with the well annulus exterior of the housing 12.

An annular floating piston 308 is received within the equalizing chamber 290 above the equalizing port 306 to provide a barrier between well fluid entering the equalizing port 306 and oil or other clean fluid which fills the equalizing chamber 290 as is further described below.

A metering cartridge 310 is disposed in the upper end of equalizing chamber 290 and is closely received between the inner and outer tubular members 42 and 44 with seals 312 and 314 sealing between the metering cartridge 310 and the inner and outer members 42 and 44, respectively.

Metering cartridge 310 is held longitudinally in place between a lower end 316 of spring chamber to equalizing chamber connector nipple 38 and a radially outwardly extending annular ledge 318 of inner tubular member 42 of equalizing chamber housing section 40.

A pressurizing passage means 320 is disposed longitudinally through metering cartridge 310 to communicate its upper and lower ends 324 and 325. Metering cartridge means 310 also includes a depressurizing passage means 322 which also communicates its upper and lower ends 324 and 325.

The upper end 324 of metering cartridge means 310 is communicated with the spring chamber 194 by a plurality of longitudinally extending ports 326 which extend through the spring chamber to equalizing chamber connector nipple 38.

The purpose of the pressurizing passage means 320 is to allow flow of fluid from the equalizing chamber 290 upward through the metering cartridge 310 to the spring chamber 194 to thereby transmit increases in well annulus pressure to the spring chamber 194.

The pressurizing passage means 320 has disposed therein an upper filter 321, a pressure relief or check valve 323, a flow restrictor 328 and a lower filter 327.

The flow restrictor 328 comprises a small orifice jet which impedes the flow of fluid from equalizing chamber 290 to spring chamber 194 so as to provide a time delay in the transmission of increases in well annulus pressure from the equalizing chamber 290 to the spring chamber 194.

The pressure relief valve 323 allows flow in an upward direction therethrough when the pressure in equalizing chamber 290 exceeds the pressure in spring chamber 194 by a predetermined value, for example 400 psi. Pressure relief valve 323 does not permit flow in a downward direction through the pressurizing passage 320.

The depressurizing passage 322 includes upper filter 329, a flow restrictor 330, a pressure relief or check valve 331 and a lower filter 332. Check valve 331 allows downward flow but prevents upward flow therethrough. Flow restrictor 330 impedes the flow of fluid downward through depressurizing passage 322 and provides a time delay in transmission of decreases in well annulus pressure from the equalizing chamber 290 to the spring chamber 194.

Figure 1B:
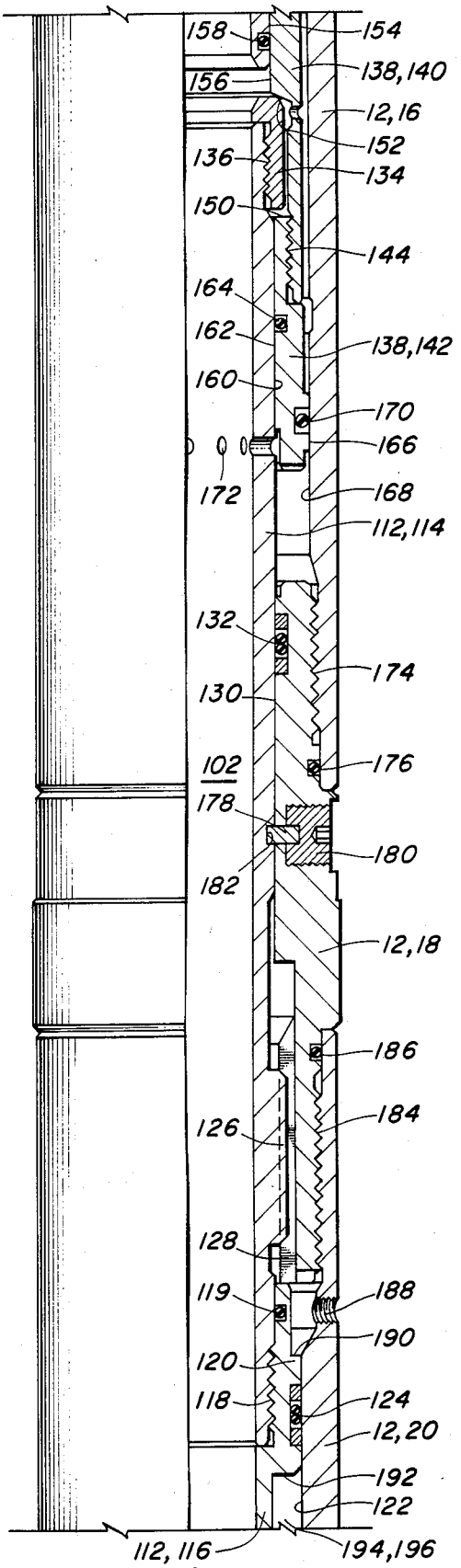
Figure 1C:
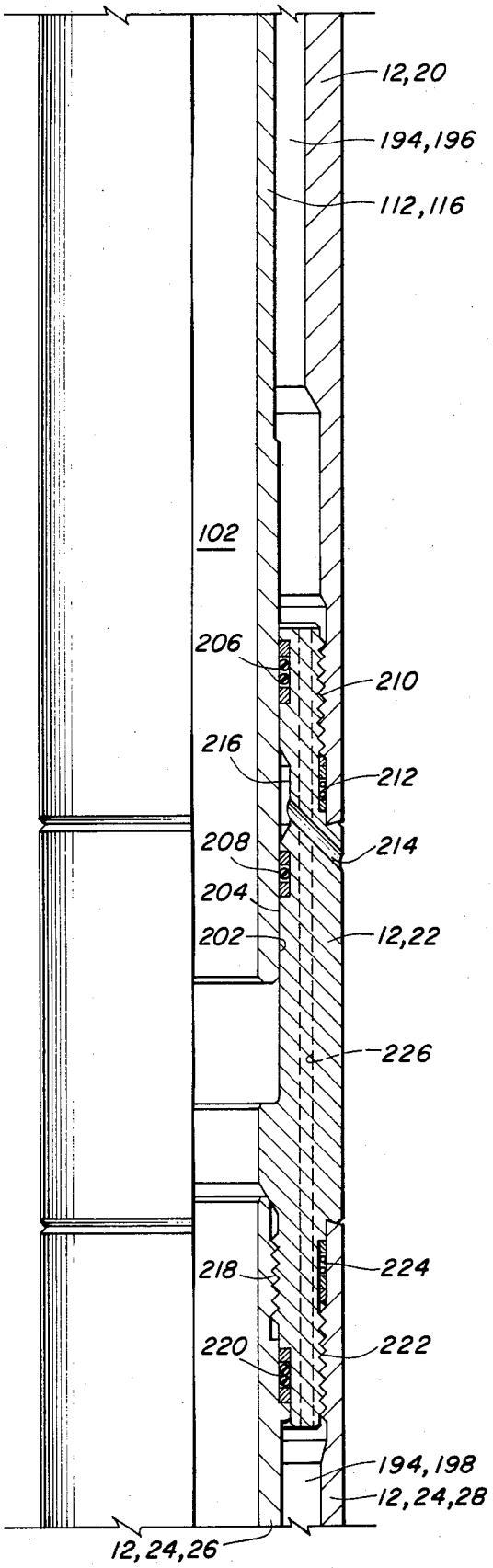
Figure 1D:
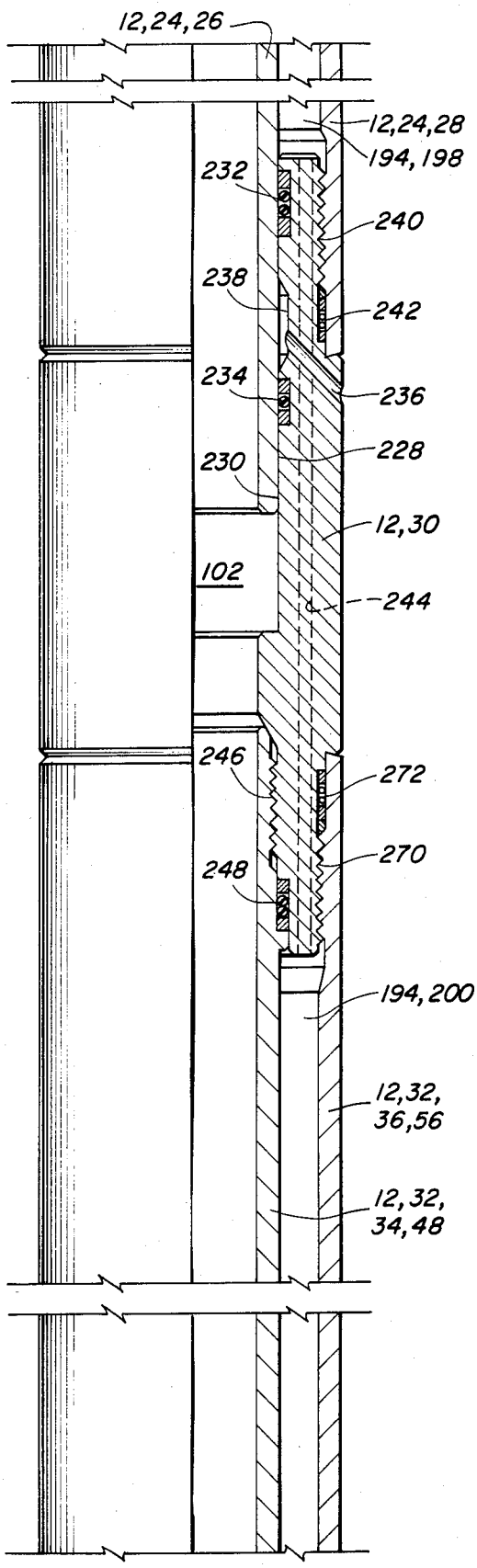
Figure 1E:
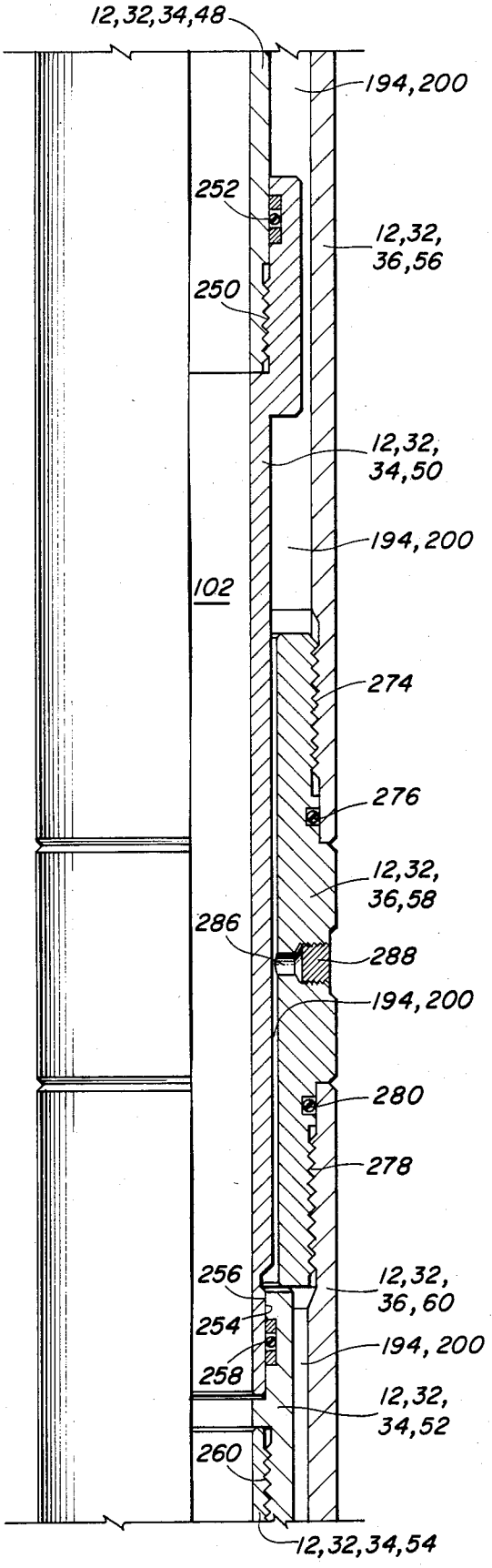
Figure 1F:
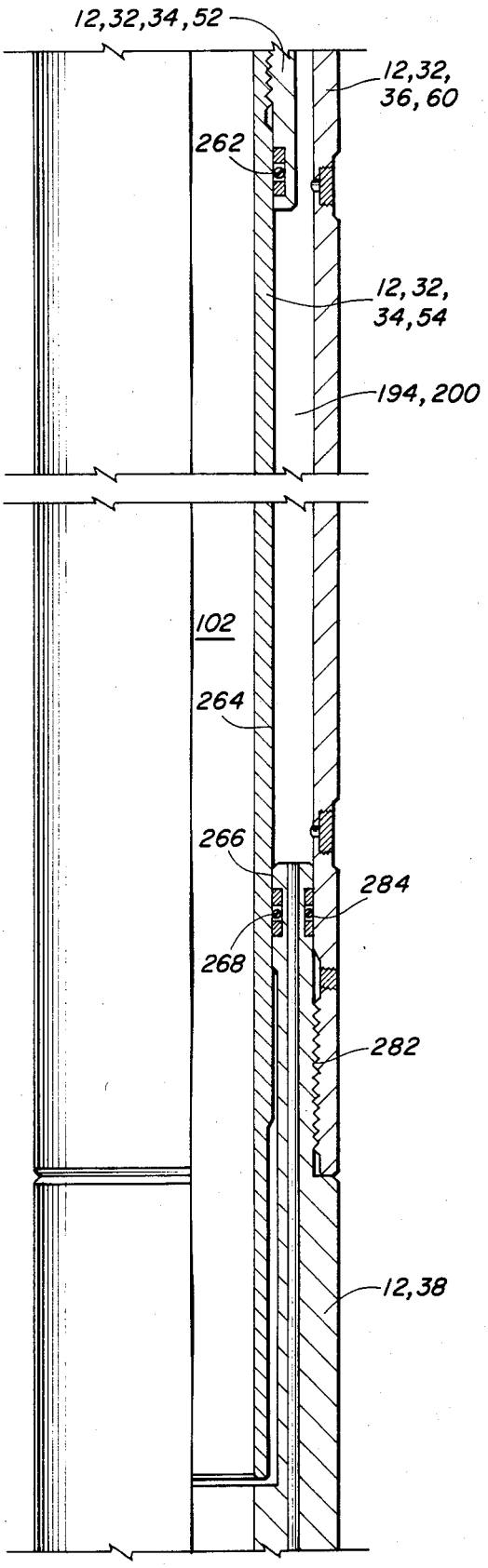
Figure 1G:
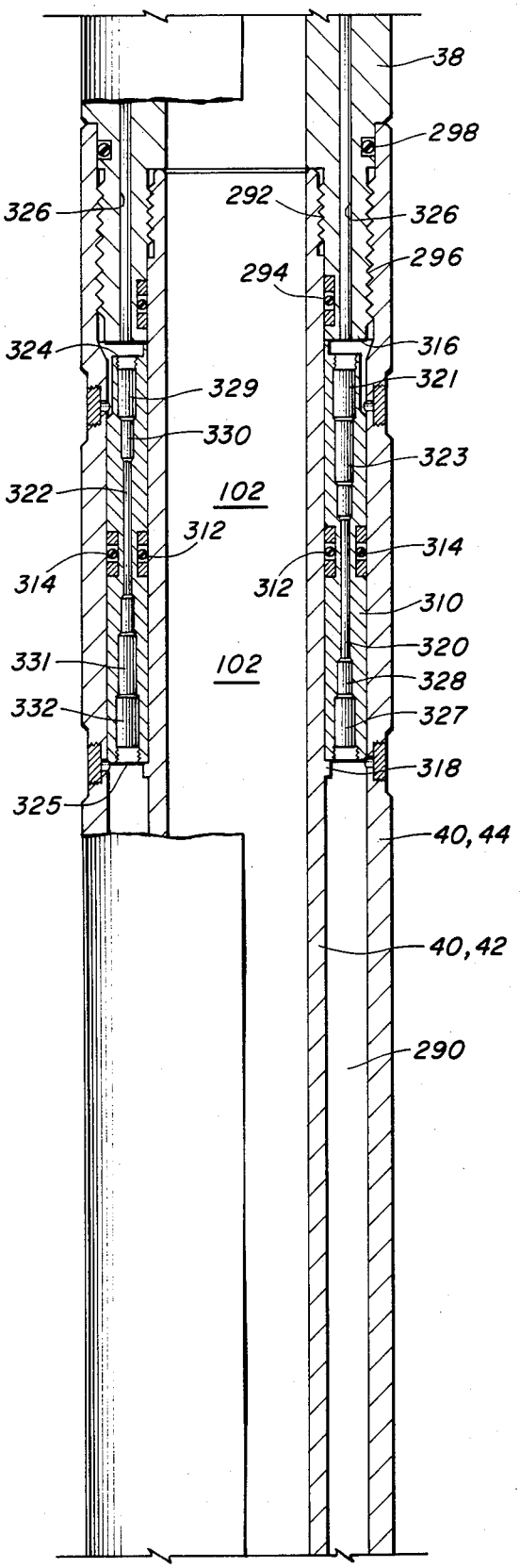
Figure 1H:
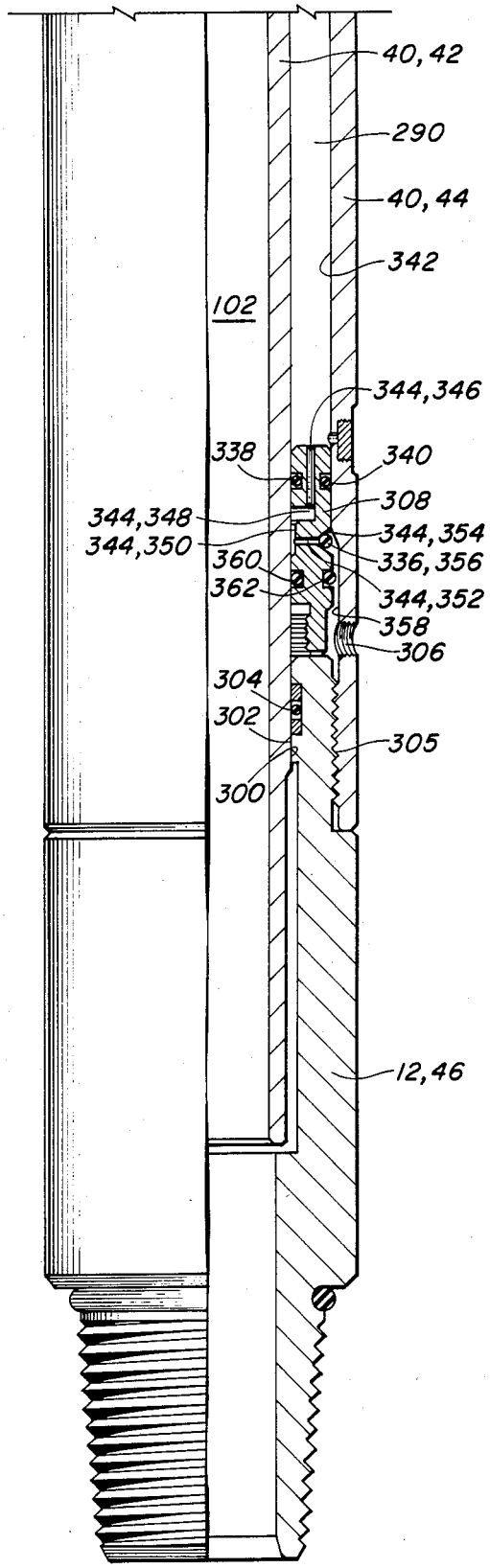

The spring chamber 194 and the equalizing chamber 290 are both preferably filled with silicone oil so that the entire volume of silicone oil will extend from seal 124 on power piston 120 down to the floating piston 308 seen in FIG. 1H.

The spring chamber 194 must contain a volume of silicone oil large enough to be compressed by an amount equal to a displacement of the power piston 120. That displacement is equal to the differential area between seals 124 and 206 multiplied by the longitudinal stroke of the piston 120 necessary to move the spherical valve member 86 from its closed position to its open position.

One problem in tools utilizing a compressible liquid spring chamber is that accommodation must be made for expansion or contraction of the compressible liquid due to temperature changes. Particularly, as the apparatus 10 is lowered into a well, temperatures will typically increase and the silicone oil contained in the spring chamber 194 and equalization chamber 290 will expand.

Typical prior art tools utilizing compressible liquid spring chambers such as those shown in U.S. Pat. Nos. 4,109,724; 4,109,725; 4,444,268; and 4,448,254, all accommodate this expansion by allowing a change in the total volume of the chambers containing the liquid. However, sometimes the expansion of the liquid in excess of the compression thereof caused by hydrostatic pressure in the well annulus reaches and would exceed the total available volume for such expansion, but for the confinement of the chambers. In such cases, the liquid reaches a higher pressure due to this confinement, and results in a higher operating pressure for the tool when annulus pressure is increased.

The present invention provides a new and improved method of accommodating this excess volume expansion of the compressible liquid.

The present invention provides a relief valve means 336 disposed in the floating piston 308 for relieving liquid from the equalizing chamber 290 to the well annulus. This occurs as follows.

The annular floating piston 308 includes radially inner and outer upper seals 338 and 340 which closely engage the outer surface 300 of inner tubular member 42 and a cylindrical inner surface 342 of outer tubular member 44.

Floating piston 308 includes a relief passage 344 which is comprised of a plurality of vertically extending bores 346, an inner annular groove 348, a reduced diameter inner annular groove 350, a plurality of radially extending ports 352, and a radially outer tapered groove 354 which is intersected by the radial ports 352.

The relief valve means 336 includes a resilient annular band 356 disposed in the tapered groove 354 such that when the band 356 is in a constricted position it closes the radial ports 352.

The outer member 44 of equalizing chamber housing section 40 includes an increased diameter bore portion 358.

When the floating piston 308 is in its lowermost position with its lower end abutting the upper end of lower adapter 46, the resilient annular band 356 is adjacent this enlarged internal diameter portion 358 of outer tubular member 44 so that when the fluid pressure within equalizing chamber 290 exceeds well annulus pressure, fluid will flow from the equalizing chamber 290 through the relief passage 344 past the resilient annular band 356 into direct contact with the well annulus fluid which may enter the housing 12 through the equalizing port 306.

If the silicone oil contained in spring chamber 194 and equalizing chamber 290 contracts due to hydrostatic pressure in the well annulus or due to temperature decreases, or when fluid from equalizing chamber 290 is pushed into spring chamber 194 due to an increase in well annulus pressure to operate the tool, the floating piston 308 will move upward within the equalizing chamber 290 and the resilient annular band 356 will prevent flow of fluid through the relief passage 344, as the annulus pressure forces it over the opening thereof. Radially inner and outer lower annular seals 360 and 362 then engage and seal against the inner and outer tubular members 42 and 44, preventing fluid flow past floating piston 308 and thus between the silicone oil and the fluid in the well annulus.

Thus it is seen that the relief passage 344 and the resilient annular band 356 of relief valve means 336 will be operational to permit fluid to flow from the equalizing chamber 290 to the well annulus only when the floating piston is in its lowermost position within the equalizing chamber 290 as shown in FIG. 1H.

The floating piston 308 can generally be described as dividing equalizing chamber 290 into an upper first zone above piston 308 and a lower second zone below piston 308.

SUMMARY OF OPERATION OF THE APPARATUS

The tester valve apparatus 10 illustrated in FIGS. 1A–1H is first made up in a testing string, like that described in detail in U.S. Pat. No. 4,448,254 for example, and will then be lowered into a well with the various parts of the apparatus 10 in the positions illustrated in FIGS. 1A–1H.

As the apparatus 10 is lowered into the well, and encounters higher temperatures, the silicone oil contained within the spring chamber 194 and the equalizing chamber 290 will expand, and silicone oil will be allowed to flow out of the equalizing chamber 290 through the relief passage 344 past resilient annular band 356 of relief valve means 336 when floating piston 308 is in its lowermost position.

The shear pins 178 seen in FIG. 1B will initially aid in maintaining the tester valve 10 in the closed position with the spherical valve member 86 blocking the flow passage 102 as seen in FIG. 1A, and thus prevent premature opening of the tester valve 10 as the tool is run into the well.

Once the test string is in place within a well, a packer of the test spring will typically be set within the well casing at some point below the tester valve 10. Alternatively, the test string may be stabbed into a previously set packer, as is well known in the art.

Then, to perform a flow test on the well, it is necessary to open the tester valve apparatus 10. This is accomplished as follows.

Well annulus pressure is increased very rapidly and this increased pressure is immediately transferred to the top side 190 of power piston 120 through the power port 188, and this increased pressure is also substantially immediately transferred to the equalizing chamber 290 through the equalizing port 306.

The metering cartridge 310, and particularly the flow restrictor 328 in the pressurizing passage 320 thereof, will provide a time delay in transmission of this increased well annulus pressure from the equalizing chamber 290 to the spring chamber 194. Typically, this time delay is designed to be on the order of approximately two minutes.

Thus, when well annulus pressure is rapidly increased, that pressure will be exerted on the top side 190 of power piston 120 while the lower side 192 of power piston 120 is still exposed to a relatively low pressure in the spring chamber 194. This pressure differential acting across the differential area between seals 124 and 206 will push downward on the power mandrel means 112 causing the shear pins 178 to shear and allowing the power mandrel means 112 to move downward within the housing 12 thus pulling the actuating arms 106 downward and rotating the ball valve 86 to an open position wherein its bore 104 is aligned with the flow passage 102 of the apparatus 10.

After this increased well annulus pressure has been maintained for a period of time greater than the time delay provided by the metering cartridge 310, the pressure within spring chamber 194 will reach a value approximately 400 psi less than well annulus pressure. This differential is created by the 400 psi relief valve 323 disposed in pressurizing passage 320.

Then, when it is desired to reclose the tester valve apparatus 10, the well annulus pressure is rapidly decreased. This decreased well annulus pressure will be immediately transmitted to the top side 190 of power piston 120.

Due, however, to the fluid flow restrictor 330 in the depressurizing passage 322 of metering cartridge 310, the pressure in spring chamber 194 will not immediately decrease, and thus there will be an upward pressure differential acting upon the power piston 120 which will move it back to its original position as shown in FIG. 1B thus moving the ball valve member 86 back to its closed position.

Again, after a period of time exceeding the time delay provided by the fluid restricter 330 in depressurizing passage means 322, the excess pressure in spring chamber 194 will be relieved through the depressurizing passage 322 so that eventually the pressure in the spring chamber 194 again reaches well annulus pressure.

Although not illustrated in the present application, a number of apparatus can be utilized to maintain the relative position of the power mandrel means 112 to the housing 12.

For example, U.S. Pat. No. 4,429,748 to Beck, and assigned to the assignee of the present invention discloses a similar structure designed for use with a compressible nitrogen gas chamber which includes as shown in FIG. 2C thereof a resilient ring assembly 206 which positively controls the fully open and fully closed positions of the ball valve.

Another such device is shown in U.S. Pat. No. 4,444,268 which has a releasable holding means 198 shown in FIG. 2D thereof to control the positive positioning of the power mandrel means of that tool.

MANNER OF MODIFYING AN ORIGINAL TOOL UTILIZING COMPRESSIBLE GAS TO INSTEAD UTILIZE COMPRESSIBLE LIQUID

The particular construction of the tester valve 10 shown in FIGS. 1A–1H, utilizing a liquid silicone oil spring chamber, is one which can be made by modifying a typical prior art compressible gas operated tester valve of the type presently utilized by the assignee of the present invention.

A typical construction for such a prior art tester valve constructed originally to operate with a compressed gas spring chamber is shown in U.S. Pat. No. 4,429,748 to Beck and assigned to the assignee of the pesent invention. Specifically, FIGS. 2A–2G of the Beck U.S. Pat. No. 4,429,748 disclose such a structure.

As is apparent from a comparison of the apparatus shown in the present disclosure to that shown in FIGS. 2A–2G of the Beck U.S. Pat. No. 4,429,748, the upper portions of the tool shown in the present application, and particularly those portions shown in FIGS. 1A–1C from the top adapter 12 down through the first spring chamber connector nipple 22, are substantially similar to the structure shown in FIGS. 2A–2D of the Beck U.S. Pat. No. 4,429,748.

The overall differences in the tools are found in the volume of the spring chamber, the displacement of the power piston, and the jetting of the metering cartridge.

With regard to the changes in the spring chamber volume, it is necessary to greatly increase the spring chamber volume in order for the tool to operate based upon a compressible liquid as compared to a compressible gas.

To modify an apparatus like that shown in the Beck U.S. Pat. No. 4,429,748, which is originally designed to operate on compressed gas, in order that such apparatus will have a sufficient spring chamber volume to operate on compressible liquid, it is necessary basically to delete those portions of the Beck U.S. Pat. No. 4,429,748 tool below its spring chamber connector nipple 258 and substitute therefor those portions of the present apparatus below the spring chamber connector nipple 22.

In the present invention, the volume of the first chamber portion 196 and the second chamber portion 198 of spring chamber 194 is approximately equal to the volume of the spring chamber in the original tool constructed to operate on compressed nitrogen.

The present invention adds the additional chamber portion 200 to the spring chamber 194 to provide a sufficient volume that the tool may operate by compressing silicone oil rather than by compressing nitrogen gas.

Additionally, the tester valve apparatus of the present invention has been modified as compared to a typical prior art nitrogen gas operating device so as to decrease the differential area of the power piston. This has been done to minimize the displacement of the power piston and thus minimize the required volume of silicone oil.

This has been accomplished by providing a modified bottom power mandrel section 116 having a power piston 120 of reduced diameter, and by providing a modified power housing section 20 having a reduced diameter inner cylindrical surface 122.

For example, in one modification of a typical prior art tool originally designed for a compressed nitrogen gas spring, the effective differential area of power piston 120 is reduced from 7.69 square inches to 3.13 square inches. This particular tool has a differential operating pressure of approximately 1500 psi both before and after the modification of the piston area.

Additionally, when modifying a tool to operate on the compression of silicone oil rather than the compression of nitrogen gas, it will be appreciated that the transfer of a given pressure change to silicone oil is accomplished with a much smaller volume compression of the silicone oil as compared to the volume compression necessary to transmit a given pressure change to nitrogen gas.

Thus, the amount of silicone oil which must flow from the equalizing chamber 290 through the metering cartridge 210 to the spring chamber 194, and in the reverse direction upon the decreasing of well annulus pressure, is much less with a tool designed for operation on compression of silicone oil as compared to a tool designed for operation on compression of nitrogen gas.

Thus, in order to provide an equivalent time delay in the communication of changes in well annulus pressure to the spring chamber, it is necessary to provide a greater restriction to fluid flow through the pressurizing and depressurizing passageways 320 and 322 of the metering cartridge 310. This is accomplished by providing flow restricters 328 and 330 having a much smaller crosssectional area through the jets thereof as compared to the restricters which would be used with a nitrogen gas tool.

Another change which will be apparent when comparing the tool of the present invention to a device such as that shown in the Beck U.S. Pat. No. 4,429,748, is that the present apparatus does not necessarily have a floating piston located above the metering cartridge means 310, whereas a tool operating on the compression of nitrogen gas will have a floating piston located near the bottom of its spring chamber to provide a boundary between nitrogen gas in the spring chamber and liquid oil located below the spring chamber (see piston 210 in FIG. 2E of the Beck U.S. Pat. No. 4,429,748). It will be appreciated that the metering cartridge 310 is designed to meter oil flow therethrough, and not gas flow.

Thus, referring to the Beck U.S. Pat. No. 4,429,748, the floating piston 210 show in FIG. 2E thereof is normally deleted when converting such a tool from nitrogen gas operation to silicone oil operation.

It is conceivable, however, that even in a tool designed to operate on compression of silicone oil, it may be desirable to provide an additional floating piston located above the metering cartridge 310. If such a floating piston were provided in the apparatus shown in the present disclosure, it would be located near the bottom of the third chamber portion 200 seen in FIG. 1F.

An additional floating piston located above the metering cartidge 310 is sometimes utilized when it is desired to have some liquid other than silicone oil flowing through the metering cartridge 310.

This additional floating piston could be located near the bottom of third chamber portion 200 with the spring chamber 194 above this additional floating piston being filled with silicone oil, and with a different type of oil being located below the additional floating piston.

Thus it will be understood that it is not literally necessary for the entire spring chamber 194 to be filled with silicone oil, but it is only necessary that a sufficient volume of silicone oil be provided to allow the change in volume necessary to accommodate the displacement of the power piston 120.

Also, if an additional floating piston were provided in the lower end of third chamber portion 200 of spring chamber 194, it will be understood that the equalizing chamber 290 would still be in fluid pressure communication with the spring chamber 194 although the fluid in equalizing chamber 190 would not be in direct fluid contact with the silicone oil in spring chamber 194.

Thus it is seen that the apparatus and methods of the present invention readily achieve the ends and advantages mentioned as well as those inherent therein. While certain preferred embodiments of the invention have been illustrated and described for purposes of the present disclosure, numerous changes in the arrangement and construction of parts and steps may be made by those skilled in the art, which changes are encompassed within the scope and spirit of the present invention as defined by the appended claims.

What is claimed is:

1. A downhole tool apparatus, comprising:

a housing;

a well annulus pressure responsive power piston means disposed in said housing and acting against a compressible liquid substantially completely filling a spring chamber of said housing, said spring chamber containing a volume of said compressible liquid large enough to be compressed by an amount equal to a displacement of said power piston means;

a liquid-filled equalizing chamber defined in said housing and communicated with said well annulus;

a restricted passageway communicating said spring chamber and said equalizing chamber;

a floating piston disposed in said equalizing chamber and dividing said equalizing chamber into a first zone and a second zone, said first zone being substantially completely filled with said compressible liquid and said second zone being substantially completely filled with well annulus fluid and in communication with the exterior of said housing;

one-way relief valve means disposed in said floating piston, for relieving liquid from said first zone to said second zone when said compressible liquid expands in said spring chamber due to heating as said apparatus is lowered into a well and pressure of said compressible liquid in said first zone exceeds well annulus fluid pressure in said second zone due to said expansion.

2. The apparatus of claim 1, wherein:

a portion of said compressible liquid may flow through said relief valve means from said first to said second zone when expansion of said compressible liquid in said spring chamber and first zone due to heating as said apparatus is lowered into said well exceeds compression of said compressible fluid due to the hydrostatic pressure of fluid in said well annulus movement of said floating piston in said equalizing chamber to accommodate said expansion is arrested.

3. The apparatus of claim 1, wherein:

said apparatus is a flow tester valve apparatus;

said housing has a flow passage disposed therethrough; and said apparatus includes a flow valve means disposed in said flow passage, said flow valve means being operatively associated with said powder piston means for opening and closing of said flow passage in response to changes in well annulus pressure.

4. The apparatus of claim 3, wherein:

said flow tester valve appartus was originally constructed to operate on compressible gas rather than compressible liquid in said spring chamber, said spring chamber having a first chamber portion from said originally constructed apparatus sized to hold a volume of gas sufficient to serve as a compressible gas spring for said flow tester valve apparatus; and said spring chamber includes an additional chamber portion sized such that said first chamber portion and said additional chamber portion in combination hold a volume of compressible liquid sufficient to serve as a compressible liquid spring for said flow tester valve apparatus.

5. The apparatus of claim 4, wherein:

said displacement of said power piston means is substantially less than a displacement of an original power piston means designed with use with said flow tester valve apparatus with said compressible gas spring.

6. The apparatus of claim 1, wherein:

said compressible liquid is silicone oil.

7. A method of substituting a compressible liquid spring for a compressible gas spring in a downhole tool, said method comprising the steps of:

(a) providing an original downhole tool constructed to operate by means of a well annulus pressure responsive power piston acting against a compressible gas disposed in a spring chamber;

(b) modifying said original tool by increasing a volume of said spring chamber; and (c) after step (b), substantially completely filling said spring chamber with a volume of compressible liquid sufficient so that said liquid may be compressed by an amount equal to a displacement of said power piston upon operation of said power piston.

8. The method of claim 5, further comprising the step of:

further modifying said original tool by decreasing an area of said power piston thereby decreasing said displacement thereof and lowering a required volume of said compressible liquid in said spring chamber, as compared to a volume of compressible liquid that would otherwise be required in the absence of said step of decreasing said area of said power piston.

9. The method of claim 7, wherein:

said step (a) is further characterized in that said original tool includes a liquid-filled equalizing chamber communicated with said well annulus, and includes an original metering cartridge disposed between said spring chamber and said equalizing chamber, said metering cartridge having a restricted passageway through which liquid must pass to transmit a change in well annulus pressure between said equalizing chamber and said spring chamber; and said method includes a step of furfher modifying said original tool by providing a modified metering cartridge having a smaller cross-section restricted passageway than said original metering cartridge, to thereby provide a reduced liquid flow rate therethrough during a given time delay period for a given pressure differential between said spring chamber and said equalizing chamber.

10. The method of claim 9, further comprising the step of:

relieving liquid from said equalizing chamber to said well annulus as said compressible liquid expands due to heating as said tool is lowered into a well if the volume of said compressible liquid exceeds the available volume for expansion of said compressible liquid in said equalizing chamber.

11. The method of claim 10, wherein said liquid is relieved through a one-way check valve disposed in a floating piston, said floating piston being disposed in said equalizing chamber.

12. The method of claim 11, wherein:

said spring chamber and said equalizing chamber are both substantially completely filled with said compressible liquid.

13. A downhole tester valve apparatus, comprising:

a housing means including in connected sequence:

an upper adapter;

a valve housing section;

an upper nipple;

a power housing section;

a spring chamber connector nipple;

an upper spring chamber housing section, including concentric inner and outer tubular members;

an upper filler nipple means;

a lower spring chamber housing section including concentric inner and outer tubular members;

a spring chamber to equalizing chamber connector nipple;

an equalizing chamber housing section including concentric inner and outer tubular members; and a lower adapter;

flow valve means disposed in said valve housing section;

annulus pressure responsive power piston means disposed in said power housing section and operatively associated with said flow valve means;

metering cartridge means, disposed in an upper end of said equalizing chamber housing section;

floating piston means disposed in said equalizing chamber housing section between said metering cartridge means and an equalizing port, said equalizing port being disposed through said outer tubular member of said equalizing chamber housing section;

a spring chamber defined within said power housing section and said upper and lower spring chamber housing sections substantially completely filled with compressible liquid; and relief valve means, disposed in said floating piston means, for allowing liquid to flow from an equalizing chamber defined in said equalizing chamber housing section into fluid contact with well annulus fluid when said compressible liquid within said spring chamber expands due to heating as said apparatus is lowered into a well and exceeds the available volume of said equalizing chamber.

14. The apparatus of claim 13, wherein:

said outer tubular member of said lower spring chamber housing section of said housing means includes upper and lower tubular portions interconnected by a lower filler nipple means, said upper and lower filler nipple means being adapted for filling said spring chamber with said compressible liquid.

15. The apparatus of claim 13, wherein:

said compressible liquid is silicone oil.

* * * * *